US005207394A

United States Patent [19]

La Fleur, Jr.

[11] Patent Number: 5,207,394

[45] Date of Patent: May 4, 1993

[54] STORAGE AND SUPPLY REEL MECHANISM FOR ELONGATED STRIP MATERIAL

[75] Inventor: Paul J. La Fleur, Jr., Wilbraham, Mass.

[73] Assignee: Package Machinery Company, Stafford Springs, Conn.

[21] Appl. No.: 893,941

[22] Filed: Jun. 4, 1992

Related U.S. Application Data

[63] Continuation of Ser. No. 564,044, Aug. 7, 1990, abandoned.

[51] Int. Cl.[5] ..... B65H 23/06; B65H 19/10

[52] U.S. Cl. ..... 242/58.6; 242/75.4; 242/64

[58] Field of Search ..... 242/58, 58.6, 68.3, 242/64, 75.4, 79, 75.47; 74/473 P, 337.5

[56] References Cited

U.S. PATENT DOCUMENTS 2,327,906 8/1943 Kiefer ..... 242/79
3,478,974 11/1969 Roscoe et al. ..... 242/58.6
4,638,957 1/1987 Graves ..... 242/58.6

*Primary Examiner*—Daniel P. Stodola
*Assistant Examiner*—John Q. Nguyen
*Attorney, Agent, or Firm*—McCormick, Paulding & Huber

[57] ABSTRACT

A storage reel mechanism for use in a gum stick wrapping machine or the like comprises a pair of similar reels for strip material arranged for alternate operation with the inoperative reel available for reloading. A reel support shaft is swingable through 180° to reverse reel position from operational to reloading. Manually operable locking mechanism releasably secures the reels in position and a brake is selectively engageable through a gear connection with the operational reel for control of the rate of delivery of strip material therefrom.

4 Claims, 3 Drawing Sheets

STORAGE AND SUPPLY REEL MECHANISM FOR ELONGATED STRIP MATERIAL

This is a continuation of co-pending application Ser. No. 07/564,044 filed on Aug. 7, 1990, now abandoned.

BACKGROUND OF THE INVENTION

This invention relates in general to an improved storage reel mechanism for use in gum stick wrapping machines and the like and, more particularly, to an improved storage reel mechanism for handling large quantities of elongated strip material and for delivering the same with minimal machine downtime interruption.

Gum stick wrapping machines equipped with storage reels of the general type under consideration are shown and described in the following patents, incorporated herein by reference:

U.S. Pat. No. 3,099,375 to Schoppee et al. issued Jul. 30, 1963.

U.S. Pat. No. 4,004,797 to Schoppee, issued Jan. 25, 1977.

U.S. Pat. No. 4,006,577 to Schoppee, issued Feb. 8, 1977.

U.S. Pat. No. 4,056,199 to Schoppee, issued Nov. 1, 1977.

U.S. Pat. No. 4,070,851 to Schoppee, issued Jan. 31, 1978.

It is the general object of the present invention to provide an improved storage reel mechanism for use in gum stick wrapping machines or the like wherein efficient high speed operation is provided for, and wherein machine downtime occasioned by changover of storage reels is minimized.

SUMMARY OF THE INVENTION

In accordance with the present invention and in fulfillment of the aforesaid object, a high speed gum stick wrapping machine is provided and includes conveyor means for successively advancing sticks of gum seriatim in side-by-side relationship. Stick wrapper storage and feed means including an improved storage reel mechanism successively advances gum stick wrapper blanks in an integral end-to-end elongated strip form, sometimes referred to in the art as a "web" or "film". A stick wrapper mechanism successively receives unwrapped sticks of gum from the conveyor together with complementary wrapper blanks severed from a leading end portion of the elongated wrapper strip. The gum sticks and wrapper blanks are successively assembled by the wrapper mechanism with the latter enveloping the former. Bands for folded assembly about the wrapped sticks are also stored on an improved reel mechanism and fed in the form of band blanks in an integral end-to-end elongated "web", "film" or strip. A band wrapper mechanism successively receives wrapped sticks of gum from the stick wrapper mechanism together with complementary band blanks severed from a leading end portion of the elongated band strip. The wrapped gum sticks and band blanks are successively assembled by the band wrapper mechanism with the latter folded about the former.

The gum stick wrapping machine also includes a stacker mechanism for successively receiving wrapped and banded gum sticks and arranging the same in stacks of pre-selected numbers of sticks. A package wrapper storage and feed means also including an improved reel mechanism in accordance with the present invention successively advances gum package wrapper blanks in integral end-to-end elongated "web", "film" or strip form. A package wrapper mechanism successively receives stacks of gum sticks together with complementary package wrapper blanks severed from a leading end portion of the package wrapper strip. The stacks of gum sticks and wrapper blanks are successively assembled by the wrapper mechanism with the latter folded about and enveloping the former.

Due in large part to an improved drive means illustrated and described in co-pending U.S. Application Ser. No. 565,798 filed Aug. 10, 1990 entitled GUM STICK WRAPPING MACHINE, now U.S. Pat. No. 5,033,250 the aforementioned gum stick wrapping machine achieves an extremely high rate of production on the order of 2,000 sticks of gum per minute. Accordingly, machine downtime is at a premium and must be minimized in all aspects of machine construction and operation. The aforementioned storage reel mechanisms employed for the stick wrapper strip, the band strip, and the package wrapper strip are or may be substantially identical and in each instance comprise a pair of similar storage reels arranged for alternate operation with an inoperative reel available for reloading. That is, an inoperative reel in an empty condition may be removed from the mechanism and replaced with a fully loaded reel during continuing machine operation with strip material being withdrawn from an operational storage reel. The time normally lost in changing reels is thus wholly eliminated. On exhaustion of the supply of strip material on the operational reel, the machine will of course be stopped but the formerly inoperative and reloaded reel is then placed in operation in an extremely short down time operation and the machine may be immediately restarted.

In providing for the foregoing mode of operation, a reel support means is adapted to mount a pair of reels in horizontally spaced apart relationship for swinging movement about a vertical axis through at least 180° between operative and inoperative or reloading positions. A manually operable locking means is provided for selectively and releasably securing the reels in said two positions i.e. in the operative or the reloading position.

A brake means associated with the reel mechanism is adapted for selective engagement with the reels in the operative position of the latter for control of the rate of delivery of the strip material therefrom. Thus, it is merely necessary to effect a manual release of the locking means, disengage the brake means, reverse positions of the reels, re-engage the brake means and wrapping machine operation may be promptly resumed.

DETAILED DESCRIPTION OF THE PREFERRED EMBODIMENT

Figure 1:
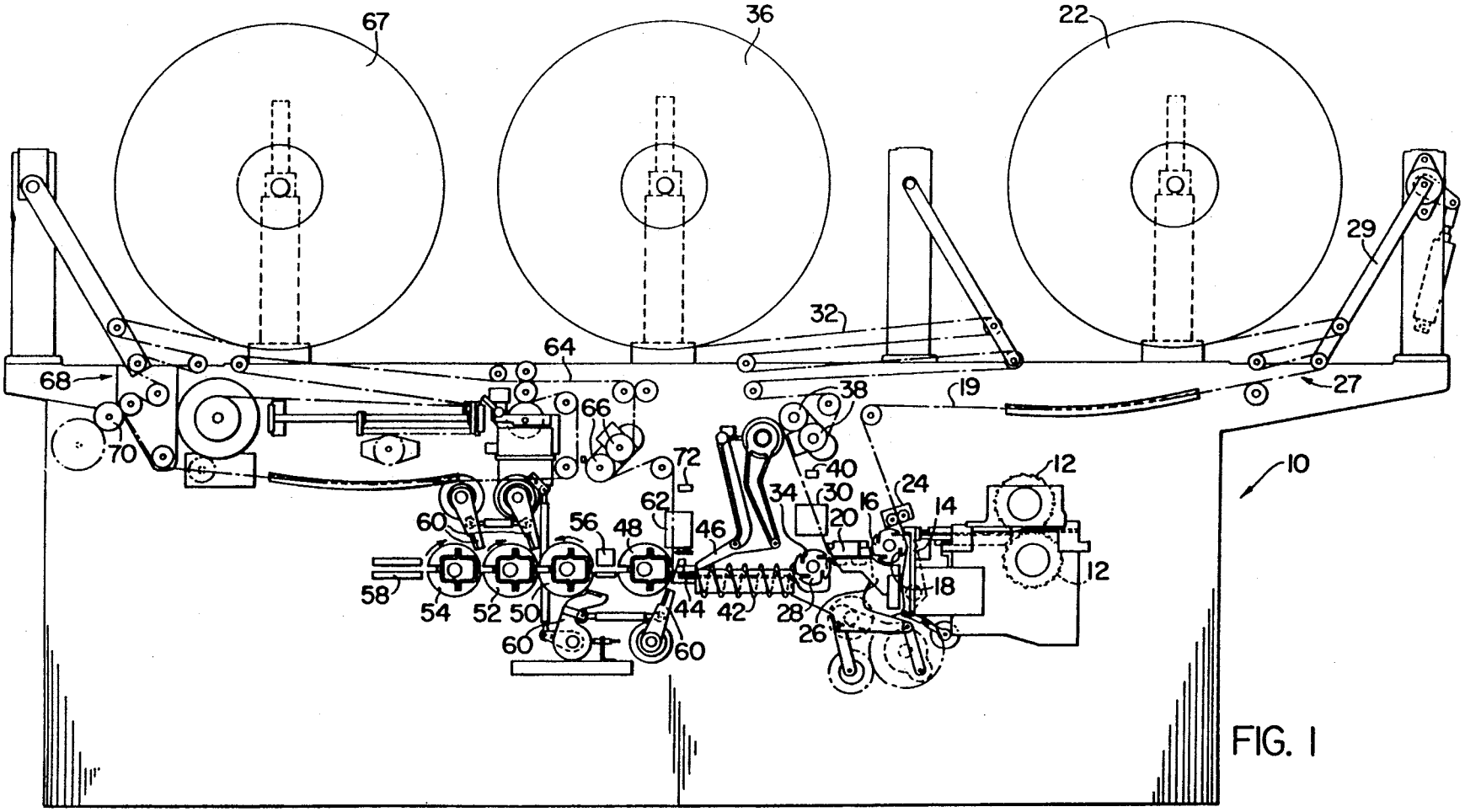
FIG. 1 is a side elevational view in schematic form of a gum stick wrapping machine including three (3) improved storage reel mechanisms constructed in accordance with the present invention.

Referring particularly to FIG. 1, a gum stick wrapping machine indicated generally at 10 comprises breaker wheels 12, 12 which break individual gum sticks from a scored slab of sticks in progression from right to left therethrough. The individual gum sticks are then fed leftwardly by conveyor means including a pusher element 14 for delivery to a first rotary folder 16. The rotary folder or "tumble box" 16 rotates in a counterclockwise direction receiving individual gum sticks in its slots 18, 18 with individual gum stick wrapper blanks partially folded thereabout. More particularly, a gum stick wrapper blank severed from a leading end portion of a strip of blanks 19 is positioned adjacent to and across the mouth of a slot 18 and as the pusher 14 urges a gum stick into the slot, the wrapper is partially folded thereabout. In subsequent rotation of the folder 16 the folder wheel cooperates with an adjacent plow mechanism and an end folder 20 to complete the folding operation of the wrapper about the gum stick and to provide for assembly of the gum stick and wrapper with the latter enveloping the former.

Individual stick wrappers are provided in blank form in integral end-to-end elongated "web", "film" or strip form and are stored on a large storage reel mechanism 22 constructed in accordance with the present invention. Feed means for the strip associated with cutter or knife 24 advance the strip drawing the same through "festoons" of rolls indicated generally at 27 and having an associated tension arm 29. As will be apparent, the leading end wrapper blanks severed by the knife or cutter 24 are delivered to the rotary folder 16 in timed relationship with the delivery of the gum sticks by the pusher 14.

A further element in a conveyor means for the machine comprises "a walking beam" mechanism 26 which removes the wrapped gum sticks from the folder 16 and end folder 20 for delivery to a next succeeding station in the machine. A second rotary folder 28 thereat forms a part of a band wrapper mechanism and has an associated knife or cutter mechanism 30 which severs leading end portions of a band strip 32. As the wrapped gum sticks are introduced to slots 34 in the rotary folder 28 they engage and partially fold the severed band blanks about themselves. Thus, subsequent counterclockwise rotation of the folder, in cooperation with an associated folding mechanism, results in a band folded completely about the wrapped stick of gum.

As in the case of the stick wrapper blanks, the band blanks are stored on reel mechanism 36 of the present invention in integral end-to-end "web", "film", or strip form. Thus, the band strip 32 is drawn from the reel 36 by feed means in the form of feed rolls 38, 38. The band blanks stored on the reel 36 in the form of strip 32 may also include registration marks as mentioned above and a sensing means in the form of a photo cell or the like is preferably provided at 40 so as to respond to the position of each registration mark on the band strip 32 as it passes thereby.

A further part of the conveyor means of the machine takes the form of a horizontal screw type conveyor at 42 which receives wrapped and banded sticks from the rotary folder 28 and transports the same leftwardly in the machine to a stacker mechanism. The latter preferably includes a vertical screw type conveyor 44 similar to the conveyor 42 and operates to receive and arrange individual sticks of gum in stacks of pre-selected numbers of sticks. For example, stacks of 5, 18 sticks etc. may be provided. The stacks of gum sticks are then urged leftwardly by a stack pusher 46 into a further rotary package folder or "tumble box" 48 in a series of four such folders or tumble boxes including the boxes 50, 52 and 54. The rotary folders or tumble boxes 48–54 have associated pusher-ejector mechanisms at 60, 60 for rotating the same and for ejecting the stacks and associated package wrappers therefrom. In right to left progression through the folders or tumble boxes 48–54 the stacks of gum sticks are enveloped within package wrappers which are also conventionally heat sealed. A long seam heat sealer is provided at 56 for the longitudinal seam along the length of a gum stock package and additional heating and sealing means are provided at 58 for sealing at the folded over end portions of the packages. The folding and sealing operations as well as the mechanism for achieving the same are for the most part conventional and reference may be had to the aforementioned patents for a more detailed discussion and illustration thereof. Similarly, reference may be had to the patents for other machine operating elements.

On entry of the initial stack to the first rotary folder or tumble box 48 a package wrapper blank is held adjacent to the stack so as to be partially folded thereabout during introduction of the stack to the rotary folder. A knife or cutter mechanism 62 severs a leading end package wrapper blank from a strip 64 advanced thereto by feed rolls 66, 66. The package wrapper strip is stored on a reel mechanism 67 of the patent invention and is drawn therefrom through a festoon arrangement 68 for delivery to feed rolls 66 with a stencil optionally applied thereto. That is, a stencil applicator is illustrated at 70 for the optional application of a stencil to the strip 64 prior to its introduction to the feed rolls 66, 66.

The package wrapper strip may also include registration marks as in the case of the band strip 32. Accordingly, a sensing means is provided for detecting the positions of registration marks on the strip and may comprise a photo cell 72.

Figure 2:
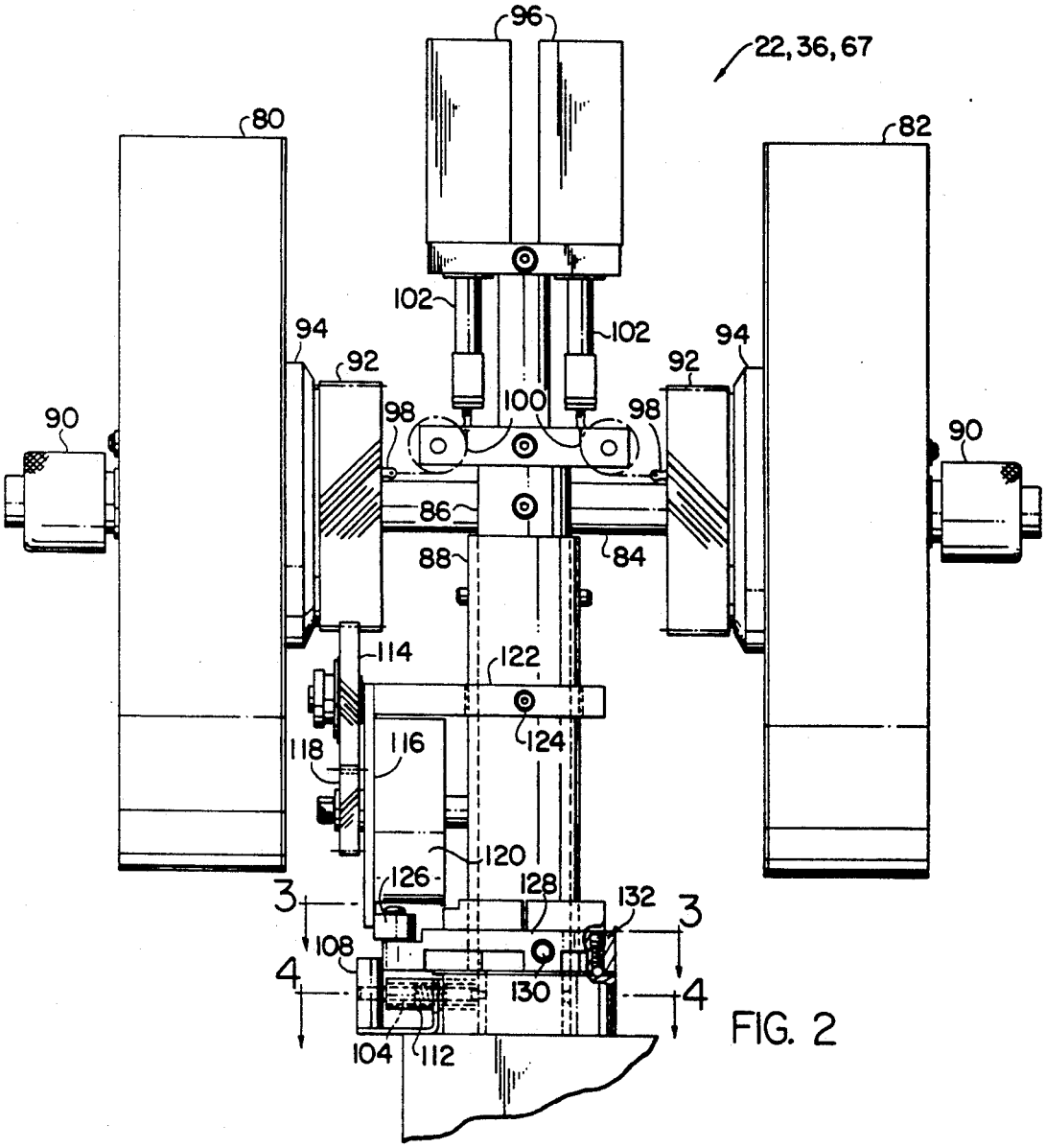
FIG. 2 is an enlarged end elevational view of an improved storage reel mechanism in accordance with the present invention.

Referring now to FIG. 2, an improved reel mechanism in accordance with the present invention is indicated generally at 22, 36, 67, the aforementioned reel mechanisms being substantially identical as mentioned. First and second substantially identical reels 80 and 82 are illustrated mounted at opposite end portions of a cross shaft 84 supported atop a vertical post 86. The post 86 is received within a sleeve 88 and is rotatable relative thereto. Thus, the reels 80 and 82 may be moved between first and second positions or, operative and reloading positions, which are shown 180° apart. That is, the reel 80 is shown at an operating position and the reel 82 at a reloading position. Each of the reels 80, 82 has an associated manually operable knob 90 for effecting minor axial adjustments of the reels in order to properly align strip material discharged therefrom with other operating devices in the gum wrapping machine or the like. Each of the reels 80, 82 is also provided with a first gear 92, 92 for operation therewith and for fulfillment of a brake-control function to be more fully described hereinbelow.

In order to provide for the quick removal and replacement of reels such as the reel 82 at the unloading position or station, a conventional quick connect and disconnect device may be provided, as for example, expanding and contracting "dogs" disposed within a hub mechanism 94 but not illustrated. As is well known, the "dogs" may be contracted for ready removal of an empty reel and thereafter expanded on mounting of a loaded reel in it's place.

In order to provide for the selective expansion and contraction of "dogs" within the hubs 94, 94 selectively operable control means in the form of fluid cylinders 96, 96 is preferably provided. The fluid cylinders 96, 96 have associated chains 98, 98 in operative association with the "dogs" within the hubs 94, 94 and which pass about sprockets 100, 100 for operation by rods 102, 102 associated with the cylinders. As will be apparent, the selective push/pull operation of the cylinder rods 102, 102 can be utilized in controlling the desired expansion and contraction of the "dogs" within the hubs 94, 94.

Figure 4A:
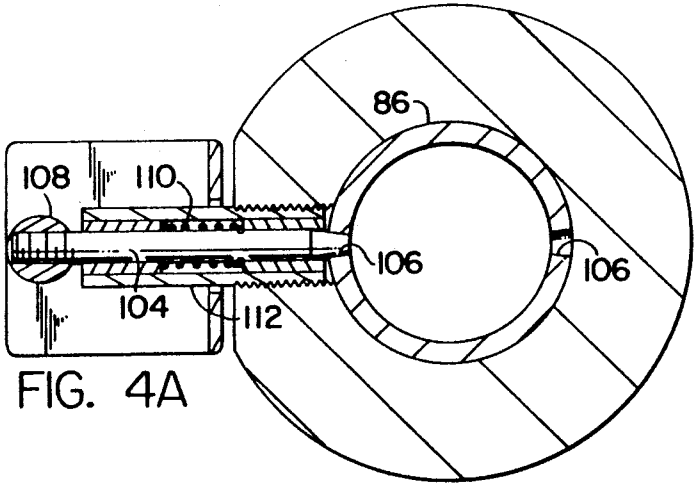
FIG. 4*a* is a horizontal sectional view taken generally as indicated at 4, 4 in FIG. 2 with a locking mechanism in its locked position.
Figure 4B:
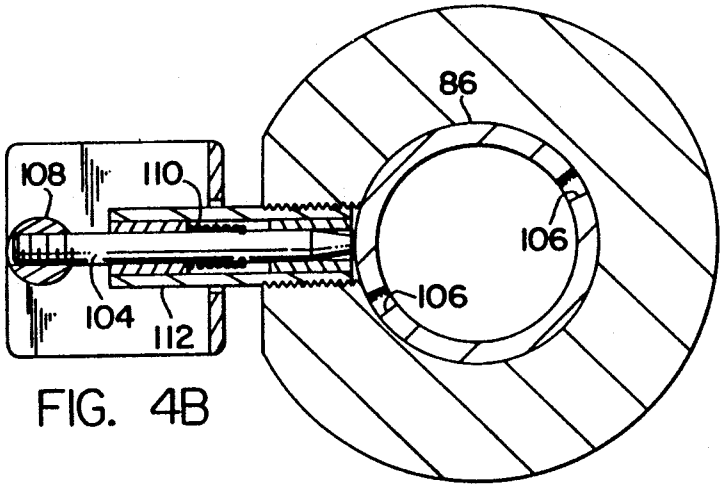
FIG. 4*b* is a horizontal sectional view taken generally as indicated as 4, 4 in FIG. 2 with a locking mechanism in an unlocked position.

In FIGS. 4*a* and 4*b*, a lock pin 104 is illustrated respectively in it's locked and unlocked position. That is, the pin 104 is shown in FIG. 4*a* with an end portion thereof entered in an appropriate opening 106 in the post 86. In FIG. 4*b*, the end portion of the lock pin 104 is withdrawn from the opening 106 with the post 86 in an intermediate position. A manually operable knob 108 at the end of the lock pin 104 provides for ready manipulation of the same in opposition to a bias spring 110 within a housing 112 for the lock pin.

As will be apparent, the lock pin 104 may be withdrawn to the FIG. 4*b* position, whereupon, the reels 80, 82 may be rotated through 180° and reversed in position from that shown in FIG. 2. On exhaustion of the strip material on the reel 82 in the operational or lefthand position of FIG. 2, the reels may once again be reversed in position with the reel 80 in the interim having been reloaded at the righthand or reloading position in FIG. 2. Machine down time is thus minimized as described above.

Reverting now to FIG. 2, it will be observed that the gears 92, 92 associated with the reels 80 and 82, are adapted for meshing engagement with a gear 114. The gear 114 takes the form of an additional or intermediate gear mounted on a plate 116 for movement therewith and is in turn in engagement with a third gear 118 also mounted on the plate 116. The gear 118 is operationally connected with a brake 120 which serves to control the rate of delivery of strip material from a reel such as the reel 80 at the operative or lefthand position in FIG. 2. The gears 92, 114 and 118 may be conventional spur gears, helical gears etc.

On reversal of the position of the reels 80, 82 it is of course necessary to provide for disengagement of one of the gears 92, 92 and the gear 114. As best illustrated in FIG. 2, the plate 116 has an associated arm 122 pivotally supported on the sleeve 88 at 124. At a lower end portion, the plate 116 is shown in FIG. 2 in engagement with a small roller 126 also illustrated in FIG. 3. The roller 126 is supported on a swingable member 128 associated with a manually operable handle 130 and supported on the sleeve 88. Thus, the swingable member 128 may be moved to the full line position of FIG. 3 for engagement with the mounting plate 116 whereby to urge the plate 116 arcuately upwardly in FIG. 2 and to maintain the gears 92 and 114 in engagement. On movement of the handle 130 to the broken line position FIG. 3 the small roller 126 is swung in a counterclockwise direction to the broken line position of FIG. 3 and the plate 116 is permitted to swing rightwardly at it's lower end portion in FIG. 2. Thus, a slight incremental downward swinging movement of the gear 114 results in disengagement of the gears 92 and 114 and the gear 92, it's associated reel 80, and the cross shaft 84 and reel 82 are free for swinging movement between the positions shown to reverse positions as aforesaid.

Figure 3:
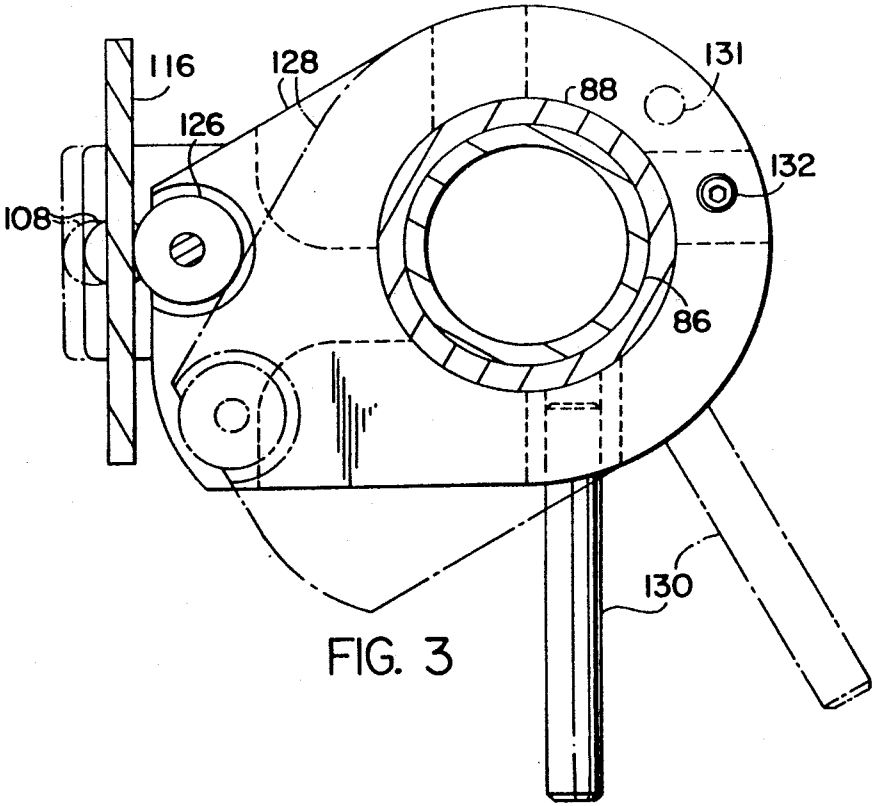
FIG. 3 is a horizontal sectional view taken generally as indicated at 3, 3 in FIG. 2.

Preferably, a spring mounted detent device as illustrated in broken line at 131 and full line 132 is provided to releasably hold the member 128 roller 126, and handle 130 in the full line or engaged position in FIG. 3.

From the foregoing it will be apparent that the improved storage reel mechanism of the present invention is of desirably simple and durable construction and is yet highly efficient in operation. On release of the lock pin 104 and movement of the handle 130, reels such as 80, 82 may be reversed in position for a rapid changeover from one operational reel to another. During operation of the machine with strip material being drawn from the operational reel, there is more than sufficient time for the relaxed removal and replacement of the reel at the reloading position. Machine down time is thus enhanced and the overall high rate of production of the gum wrapping machine or the like is maintained.

I Claim:

1. A storage and supply reel mechanism for use in a gum stick wrapping machine requiring the storage and supply of a large quantity of elongated strip material and delivery of the same with minimal downtime interruption; said mechanism comprising a pair of similar storage and supply reels for the strip material arranged for alternate operation so that one reel is in an operational position while the other is in an inoperative position and available for reloading or replacement with a loaded reel, a reel support means for mounting the reels in horizontally spaced apart relationship for pivotal movement about a vertical axis through at least 180° between said operational and inoperative positions, manually operable locking means for selectively and releasably securing said reels in said two positions, and a brake means supported on said support means and selectively engageable with a reel in the operational position to control the rate of delivery of strip material from said reel, said brake means comprising first and second reel gears respectively associated with said storage and supply reels a brake gear operatively associated with said brake, and an intermediate gear driven by said brake gear, said intermediate gear selectively associated with and drivingly rotatable with a reel gear with its reel located at the operational position, said brake and intermediate gears being mounted on a pivotally supported mounting plate, said intermediate gear being pivotable toward and away from said reel gear by said mounting plate respectively for engagement with and disengagement therefrom, and wherein a manually operable means is provided for engaging said intermediate gear with said reel gear to control the rate of delivery of strip material from a reel at the operational position, and for disengaging said intermediate gear to accommodate movement of the reels between said operational and inoperative positions, said manually operable means taking the form of a handle moveable between first and second positions and which carries a small roller engageable with said mounting plate, said roller being engageable with said plate in a first position whereby to cause said plate to pivot slightly and to cause said reel and intermediate gears to engage, and said roller being disengaged from said plate in a second position of said handle whereby to allow said reel and intermediate gears to disengage.

2. A storage and supply reel mechanism for use in a gum stick wrapping machine or the like as set forth in claim 1 wherein said reel support means comprises a vertical support post rotatable within a vertical sleeve and carrying at an upper end portion a cross shaft mounting the storage and supply reels at opposite ends thereof, and wherein said plate mounting said brake and intermediate gears is pivotally supported on said sleeve for the aforesaid pivotal movement engaging and disengaging said intermediate gear and said reel gear.

3. An improved storage reel mechanism for use in a gum stick wrapping machine or the like as set forth in claim 1 wherein said reel support means includes quick connect and disconnect means for mounting the reels, said means being selectively operable for the ready removal and replacement of reels at the reel inoperative position.

4. An improved storage reel mechanism for use in a gum stick wrapping machine or the like as set forth in claim 3 wherein said quick connect and disconnect means includes fluid operable cylinders for the selective connection and disconnection of a reel in mounted position on the reel support means.

* * * * *